US006393804B1

(12) United States Patent
Ausnit

(10) Patent No.: US 6,393,804 B1
(45) Date of Patent: May 28, 2002

(54) METHOD OF FORMING OPEN MOUTH ZIPPER GUSSET BAG

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 51 days.

(21) Appl. No.: 09/638,628

(22) Filed: Aug. 14, 2000

(51) Int. Cl.[7] ..... B65B 61/18; B65B 9/00; B31B 1/90

(52) U.S. Cl. ..... 53/412; 53/451; 493/203; 493/213; 493/214; 493/243

(58) Field of Search ..... 53/412, 450, 451, 53/455, 469, 133.1, 133.3, 133.4, 138.1, 139.2, 548, 550, 551, 552; 493/189, 203, 212, 213, 214, 223, 243, 416, 439; 383/63, 66, 120; 156/66

(56) References Cited

U.S. PATENT DOCUMENTS 4,617,683 A * 10/1986 Christoff ..... 493/214
4,840,611 A * 6/1989 Van Erden et al. ..... 493/213
4,909,017 A * 3/1990 McMahon et al. ..... 53/412
5,161,350 A * 11/1992 Nakamura ..... 53/412
5,186,707 A * 2/1993 Barta ..... 493/439
5,275,491 A * 1/1994 Kuge et al. ..... 383/63
5,692,837 A * 12/1997 Beer ..... 383/120
5,782,733 A * 7/1998 Yeager ..... 53/412
6,116,314 A * 9/2000 Johnson ..... 383/66
6,254,519 B1 * 7/2001 Toshima ..... 53/412

* cited by examiner

*Primary Examiner*—Stephen F. Gerrity
*Assistant Examiner*—Louis Huynh
(74) *Attorney, Agent, or Firm*—Pitney, Hardin, Kipp & Szuch LLP

(57) ABSTRACT

A method of forming a gusseted plastic zipper bag. The zipper profiles are provided intermittently on a carrier web, the thickness of which is less than the bag film, the carrier web is attached to the bag film that has windows cut therein that are aligned transversely so that profile-free section of the carrier web covers the windows. During bag formation the sections of the bag film with windows covered by the carder web are folded to form gussets.

9 Claims, 2 Drawing Sheets

METHOD OF FORMING OPEN MOUTH ZIPPER GUSSET BAG

BACKGROUND

1. Field of the Invention

This invention relates to the manufacture of gusseted plastic zipper bags, and particularly to a method for manufacturing such bags with the zipper running transversely to the film feed direction of a vertical form, fill and seal machine on which the bags are formed.

2. Description of the Prior Art

It has heretofore been suggested to provide gusseted zipper bags wherein profile-free sections of the gusset are captured between the zipper profiles. The zipper-free areas of such bags have the thickness of the bag film and hence the mating zipper profiles which capture these areas has to be sufficiently loose fitting to permit such capture which compromises the tightness and security of the zipper closure or requires unduly thin bag walls.

SUMMARY OF THE INVENTION

An object of this invention is to provide a method of forming gusseted zipper bags, wherein the portions of the gusset which are captured between the mating zipper elements is relatively thin with respect to the remainder of the bag walls. A further object is to provide such a method which may be practiced on conventional form, fill and seal equipment with relatively minor modification.

The above and other beneficial objects and advantages are attained in accordance with the present invention by cutting transversely aligned windows into a bag making film. The windows are provided at locations corresponding to the gusseted walls of the bags to be formed and aligned with the locations at which profile is to be attached. A carrier web bearing intermittent lengths of zipper is attached to the film with profile-free areas covering the windows. The thickness of the carrier web is relatively thin with respect to the thickness of the bag film

DETAILED DESCRIPTION OF THE PREFERRED EMBODIMENTS

Figures 1, 2:
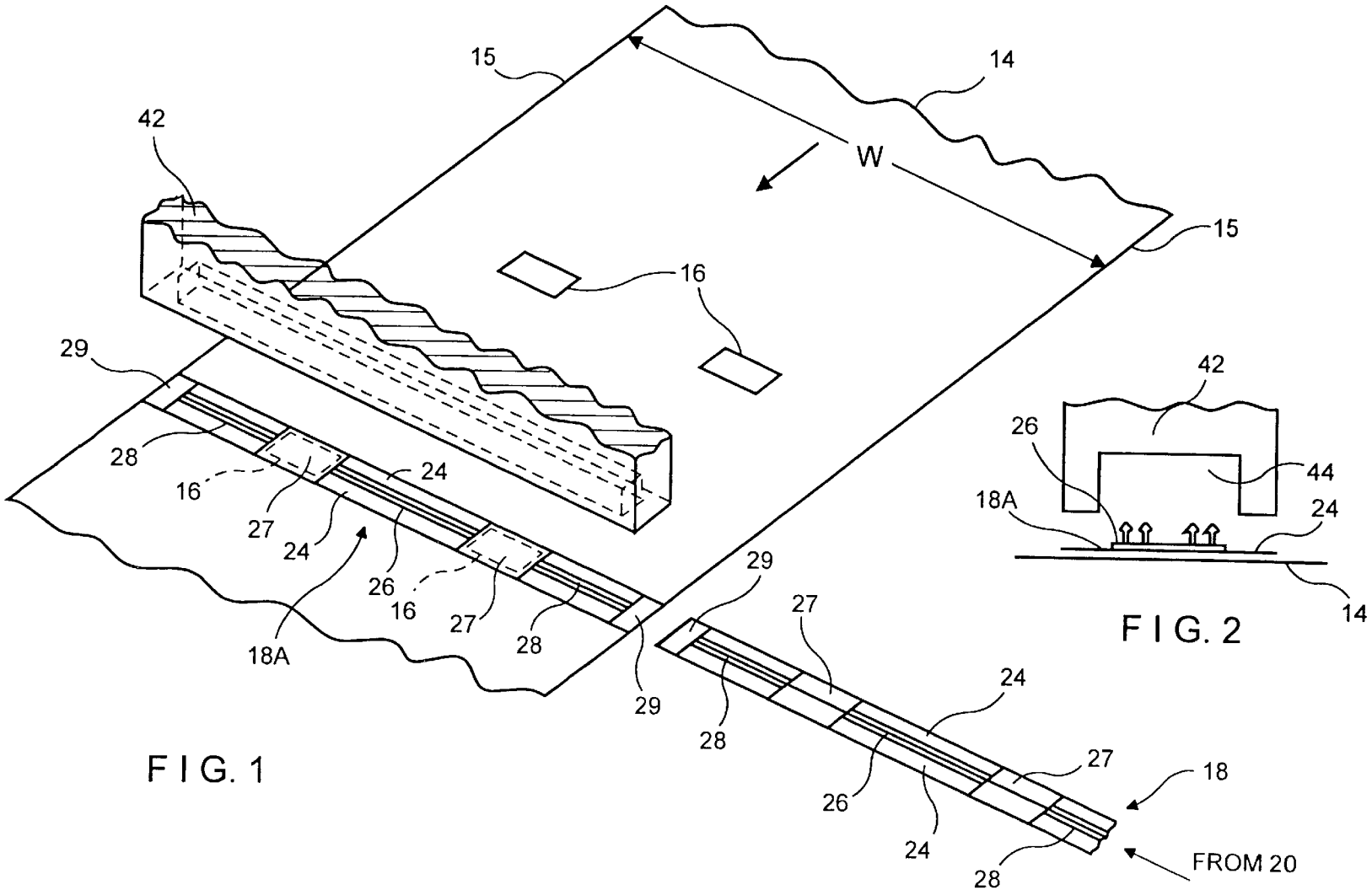
FIG. 1 is a schematic perspective view showing attaching a transversely positioned to carrier web with intermittent zipper sections to a bag film with windows cut out.
FIG. 2 is a fragmentary detail view of the carrier web bearing zipper profile being attached to the bag film

In FIG. 1 a carrier web 18 bearing intermittent zipper elements is fed transversely onto a bag film 14 which has transversely aligned cutouts or windows 16. These window areas 16 are provided in the portions of the bag film 14 that will be folded to form the gusset walls of the bag with said window areas being then captured between the mating zipper profile elements of the completed bag.

In this manufacturing stage carrier web 18 is supplied from a source 20 (not shown) and moved in a direction traverse to the feed direction of bag film 14.

The carrier web 18 has a repeating pattern of a central zipper section 26, a pair of zipper-free areas 27 at opposite ends of the central zipper section 26, and a pair of shorter zipper end elements 28 at opposite ends of the zipper-free areas 27. Margin portions 24 are provided adjacent both sides of the zipper extending to the edges of carrier strips. Finally, there is a pair of end seal areas 29 at the opposite ends of the zipper end elements.

As further indicated in FIG. 1 a length of carrier web 18A including a repeat of the above pattern has been positioned to overlie transversely the bag film 14 and to extend between the opposite side edges 15 of the film. The length of carrier strip 18A is substantially the same as the width W between the side edges 15 of film 14. The same reference numbers are used for components of carrier web 18 and the single repeat 18A.

The movement of the carrier strip 18A, and movement of the film 14 is coordinated or indexed so that the zipper-free areas 27 of the carrier web will overlie the windows 16 of the bag film; then the seal bar 42 descends to seal the carrier strip along its margins 24 to the bag film.

The attachment phase of the carrier web 18 to the bag film 14 is further illustrated in FIG. 2 which shows seal bar 42 which descends to seal the edges 24 of the carrier web to the bag film 14. Atop carrier web 18A is the zipper profile 26 schematically shown as four unisex projections of a multi-track zipper. The shape of the profile of the zipper being such as to enable it to engage and interlock with itself. While a unisex zipper construction will reduce alignment problems when the zipper is folded on itself around the fill tube, other male, female constructions, with provided alignment means, can also be used. Above the carrier web profile is recess area 44 in the seal bar to allow sealing of the side margins of the carrier web without interference with or damage to the zipper profile. The seal bar also includes end sections to seal the end-seal areas 29 of the carrier web to the bag film.

As noted above, the areas of the gussets to be captured within the bag profiles is to be formed of thinner film than the remainder of the gusset to facilitate that portion being captured by the profiles. FIGS. 3–6 illustrate how a bag film prepared according to FIGS. 1 and 2 with the thinner film covering the window areas may be formed into a side-gusseted reclosable bag.

Figure 3:
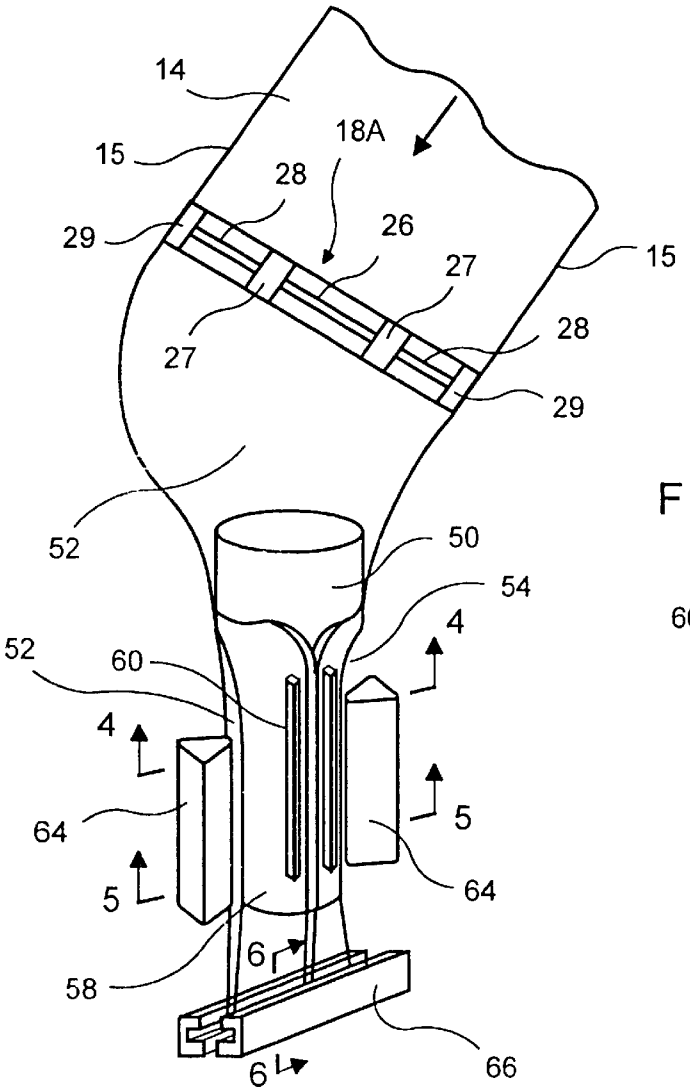
FIG. 3 is a perspective view of the fill tube of a form-fill seal machine about which the bag film is formed into a side-gusseted bag.

Accordingly, FIG. 3 shows the filling or forming tube 50 of a vertical form, fill and seal machine having a forming collar at a top end 52, tapered neck 54, gusset-forming recess 56 and bottom end 58. The bag film 14 is brought downward over the forming collar and wrapped around fill tube 50. As the bag film is moved downward and wrapped, the opposite side edges 15 are brought together and sealed along longitudinal seal 60 seen in FIG. 5 formed by side seal bars 62.

Figure 4:
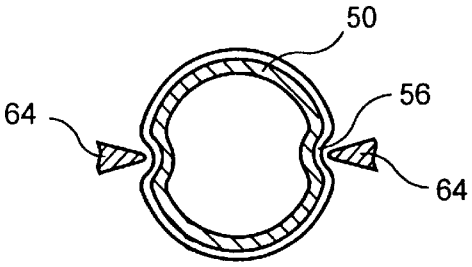
FIG. 4 is a sectional view taken along line A—A of FIG. 3 showing initial formation of the side gussets.
Figure 5:
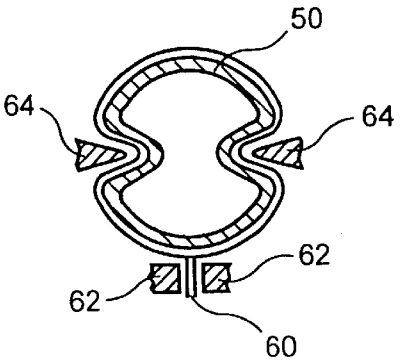
FIG. 5 is a sectional view taken along line B—B of FIG. 3 showing a later stage of gusset formation and a longitudinal side seal.

FIG. 4 shows the initial phase of side gusset formation as gusset-forming bars 64 begin to press the film inward into recesses 56 of the filling tube 50 extending lengthwise and radially inward on opposite sides of fill tube 50. FIG. 5 shows further and almost complete gusset formation which occurs lower down on the fill tube.

Figure 6:
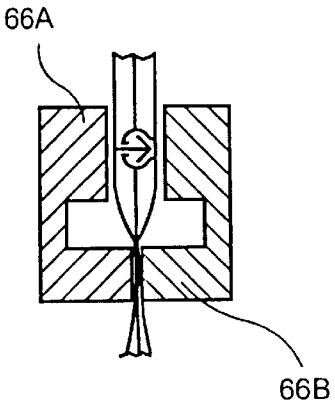
FIG. 6 is a sectional view taken along line C—C of FIG. 3 showing the bottom seal step in the bag construction.

Finally, as seen in FIGS. 3 and 6, below the bottom of the fill tube the lower seal bars 66 will converge against the front and rear bag surfaces, with the upper part of the lower seal bar 66A pressing the zipper together into interlocking relationship and the lower part of the lower seal bar 66B sealing these surfaces to each other thereby closing the bottom of the newly formed bag. In typical apparatus this seal operation simultaneously seals the top of the previously formed bag which has been filled by product entering through the fill tube. The sealing bars further serve to cut the seal area to separate the formed and filled lower bag from the bag being formed and filled.

The embodiments disclosed herein are for illustration purposes, it being understood that variations in structure and method are possible within the scope of the appended claims.

What is claimed is:

1. A method of forming a gusseted plastic zipper bag, comprising the steps of:

a. providing a continuous bag film with opposite side edges defining a width dimension of said bag, b. cutting in said bag film a spaced-apart pair of windows aligned the width dimension of said bag film, c. positioning a length of carrier web which has a thickness less than that of said bag film to transversely overlie said film, said length of carrier web including thereon a generally central section of zipper profile, a pair of zipper-free areas at opposite sides of said central section of zipper profile, and a pair of end sections of zipper profile at opposite ends of said zipper-free areas aligned with said central section of zipper profile, said two zipper-free areas being positioned to overlie and cover said pair of windows, d. sealing said length of carrier web onto said bag film, and.

e. forming said bag film with said length of carrier web a hacked thereon into a bag.

2. A method according to claim 1 wherein said length of carrier web has side sections along its length on opposite sides of said zipper profile, and said sealing step comprises sealing said side sections of said length of carrier web to said bag film.

3. A method according to claim 1 wherein said zipper profile comprises unisex projections extending from said central section of zipper profile which projections are releasably engageable with similar projections extending from said end profile sections when said end profile sections are positioned to overlie and engage said central profile section and said bag forming step comprises joining said bag film opposite edges so as to position said end profile sections over said central profile sections.

4. A method according to claim 1 wherein said generally central section of zipper profile comprises one of a male profile and a female profile, said profiles being adapted to interlock with one another and said pair of end sections of zipper profile comprises the other of said male and female profiles.

5. A method according to claim 1 wherein said bag forming step comprises the further steps of a. advancing said bag film with said length of carrier web attached thereon longitudinally along and around a fill tube of a form, fill and seal machine, with said length of carrier web disposed transversely to the direction of movement of said bag film so as to transform said bag film into a tube.

6. A method according to claim 5 including the steps of:

a. folding in, from opposite sides, said tube formed from said bag film to form gussets at said zipper-free areas between said central section of zipper profile and said end sections of zipper profile.

7. A method according to claim 6 comprising the further steps of sealing a bottom end of said tube formed from said bag film, filling product into said tube, cross-sealing the top of said tube so as to form said bag, and cutting through said top cross-seal to sever said filled bag from the section of said tube above it.

8. A method according to claim 1 wherein said length of carrier web includes margins adjacent both sides of said zipper sections and said sealing steps comprises sealing said margins to said bag film.

9. A method according to claim 1 wherein said length of carrier web includes zipper free end sections at opposite sides of said pair of end sections of zipper profile and said sealing step includes sealing said zipper free end sections to said bag film.

* * * * *